US008547291B1

(12) United States Patent
Josypenko

(10) Patent No.: US 8,547,291 B1
(45) Date of Patent: Oct. 1, 2013

(54) DIRECT FED BIFILAR HELIX ANTENNA

(75) Inventor: Michael J. Josypenko, Norwich, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 275 days.

(21) Appl. No.: 13/194,345

(22) Filed: Jul. 29, 2011

(51) Int. Cl.
*H01Q 1/36* (2006.01)

(52) U.S. Cl.
USPC ..... 343/895

(58) Field of Classification Search
USPC ..... 343/895
See application file for complete search history.

(56) References Cited

U.S. PATENT DOCUMENTS

| | | | | |
|---|---|---|---|---|
| 6,407,720 | B1 * | 6/2002 | Josypenko | 343/895 |
| 6,552,695 | B1 * | 4/2003 | Strickland | 343/895 |
| 7,372,427 | B2 * | 5/2008 | Leisten | 343/895 |
| 2013/0135169 | A1 * | 5/2013 | Christie | 343/841 |

* cited by examiner

*Primary Examiner* — Tan Ho
(74) *Attorney, Agent, or Firm* — James M. Kasischke; Jean-Paul A. Nasser; Michael P. Stanley

(57) ABSTRACT

The invention as disclosed is a direct fed bifilar helix antenna. The bifilar helix is lengthened as needed to obtain the desired unidirectional pattern. The bifilar helix is employed as an infinite balun to bring a feed cable onto the antenna structure and eventually connect the feed cable to the antenna feed point. The bifilar elements are widened such that the combined width of each element is as wide as practically possible before the elements touch and/or overlap (approximately 98.5% of the available width) so that the practical lowest characteristic impedance value of approximately 50 ohms is obtained so that there is no need for a matching network.

20 Claims, 2 Drawing Sheets

DIRECT FED BIFILAR HELIX ANTENNA

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

This patent application is co-pending with a related patent application entitled TAPERED DIRECT FED BIFILAR HELIX ANTENNA Ser. No. 13/194,382, by Michael J. Josypenko the same named inventor to this application.

BACKGROUND OF THE INVENTION (1) Field of the Invention

The present invention is directed to helical antennas. In particular, the present invention is directed to a direct fed bifilar helix antenna that is broadband with low characteristic impedance.

(2) Description of the Prior Art

There exists in the prior art a family of broadband quadrifilar helix antennas such as the antennas described in U.S. Pat. No. 6,246,379 (Josypenko), that have the characteristics of being broadband above a cut-in frequency, and having a low voltage standing wave ratio (VSWR) above a cut-infrequency about the characteristic impedance ($Z_0$) value of the antenna. Wide element quadrifilar helix antennas reduce the value of $Z_0$ to a practical lower limit of $Z_0$=100 ohms, which can then feed into the $Z_0$=100 ohms between the two center conductors of a one hundred eighty degree power splitter feeding a given bifilar. The wide element quadrifilar helix antenna taught in U.S. Pat. No. 6,246,379 (Josypenko), comprises two crossed bifilar helixes and a 50 ohm ninety degree power splitter feeding two 50 ohm one hundred eighty degree power splitters feeding their two 100 ohm outputs directly into the two crossed bifilar helixes making up the quadrifilar helix. The wide element quadrifilar helix antenna does not require a matching network. The antenna is directly fed via its power splitter feed network.

The broadband impedance properties exhibited by wide element quadrifilar helix antennas also apply to bifilar helixes, since the quadrifilar helix is an array of two crossed bifilar helixes. The bifilar helix is the basic building block of the quadrifilar helix. A difference in the characteristic impedance $Z_0$ between a wide element quadrifilar helix antenna (i.e., two crossed bifilars) and a wide element bifilar helix antenna is that when changing from two crossed bifilars to one, with the width of a bifilar element being the combined widths of the two quadrifilar elements it replaces, then the characteristic impedance is halved.

The halving of the characteristic impedance $Z_0$ is explained as follows with accompanying FIGS. 1*a* and 1*b*. $Z_0$ is calculated according to $$Z_0 = \sqrt{\frac{L}{C}},$$

where L is the series inductance per unit length of the helix and C is the shunt capacitance per unit length of the helix. FIG. 1*a* shows a section 7 of quadrifilar helix unpitched the sources of capacitance per unit length of helix C along the helix length. The section is composed of sections 1, 2, 3 and 4 of the 4 elements of the helix of length 6 that is ⅛ wavelength or less, separated by small gaps $G_{12}$, $G_{23}$, $G_{34}$, $G_{41}$, all centered about helix axis 5. The capacitance between radially opposite elements 1 and 3 is shown as $C_{13}$ between midpoints $M_1$ and $M_3$ of the element sections, capacitance $C_{24}$ exists between midpoints $M_2$ and $M_4$ of element sections 2 and 4. Capacitance also exists between the elements at their gaps as $C_{12}$, $C_{23}$, $C_{34}$ and $C_{41}$ between element sections 1 and 2, 2 and 3, 3 and 4, and 4 and 1. Since the elements are much closer together at their gaps, the inter-gap capacitances are much larger than the radial capacitances. Thus, when finding the total capacitance between the midpoints of two radially opposite element sections, the radial capacitances $C_{13}$ and $C_{24}$ can be ignored. Thus, the capacitance between element sections 1 and 3 is the series capacitance of $C_{12}$ and $C_{23}$ in parallel with the series capacitance of $C_{41}$ and $C_{34}$, or:

$$C_{Total} = \left(\frac{1}{\frac{1}{C12} + \frac{1}{C23}}\right) + \left(\frac{1}{\frac{1}{C41} + \frac{1}{C34}}\right)$$

with $C_{12}$=$C_{23}$=$C_{34}$=$C_{41}$=C from symmetry, $$C_{Total} = \frac{2}{\frac{1}{C} + \frac{1}{C}} = \frac{2}{\frac{2}{C}} = C.$$

This is the capacitance per unit length between either pair of radially opposite elements. When the quadrifilar helix is changed to a bifilar helix, gaps $G_{12}$ and $G_{34}$, for example, are removed so that elements 1 and 2 combine to become the first element of the bifilar and elements 3 and 4 combine to become the second element of the bifilar. $C_{12}$ and $C_{34}$ are shorted out and disappear, so now the capacitance between only two element sections at new midpoints $M_1M_2$, and $M_3M_4$ becomes: $C_{Total}$=$C_{23}$+$C_{41}$=2C.

FIG. 1*b* shows the quadrifilar elements $E_1$, $E_2$, $E_3$ and $E_4$ unwrapped and unpitched to more easily show the inductance per unit length $L_1$, $L_2$, $L_3$ and $L_4$ of the elements in section 7. Due to symmetry, $L_1$=$L_2$=$L_3$=$L_4$=L. When the quadrifilar helix is changed to a bifilar case, element sections 1 and 2, for example, combine to a first bifilar element and element sections 3 and 4 combine to a second bifilar element. Gaps $G_{12}$ and $G_{34}$ are filled and disappear, and now the ends of $L_1$ and $L_2$ are considered connected with virtual connections $C_{121}$ and $C_{122}$; ends of $L_3$ and $L_4$ are considered connected with virtual connections $C_{341}$ and $C_{342}$. The inductance per unit length becomes the parallel combination of L1 and L2, or L3 and L4, or the inductance per unit length is $$= \frac{1}{\frac{1}{L1} + \frac{1}{L2}} = \frac{1}{\frac{2}{L}} = \frac{L}{2}.$$

The characteristic impedance $Z_0$ for a loss less transmission line is found by $$Z_0 = \sqrt{\frac{L}{C}}.$$

For the quadrifilar helix $$Z_0 = \sqrt{\frac{L}{C}}.$$

When the quadrifilar helix is converted to a bifilar helix, $Z_0$ becomes:

$$Z_0 = \sqrt{\frac{\frac{L}{2}}{2C}} = \frac{1}{2}\sqrt{\frac{L}{C}}.$$

Thus $Z_0$ is halved when the quadrifilar helix becomes a bifilar helix. Note this is an approximation for the case when the gap width is small. An even more precise value of $Z_0$ can be obtained by adjusting the gap width, even if necessary to the point of negative gap width values, in which case the element edges overlap but do not touch.

A prior art bifilar helix antenna made of moderate width elements and a diameter of nine inches was investigated. To match the high characteristic impedance ($Z_0$) elements of the helix to 50 ohms, a quarter wavelength transmission line transformer is connected at the feed point of the bifilar antenna. The outer conductor connects to the feed point of the first element, the center conductor connects to the second element's feed point. The other end of the line is at 50 ohms over a certain bandwidth and connected to a 50 ohm cable. The whole length of the higher $Z_0$ cable connected to the 50 ohm cable follows the first element from its feed point to the unfed end fire of the antenna, exiting at a short placed across both elements at this end. Thus the bifilar antenna is used as an infinite balun to be able to bring a coaxial feed cable onto the antenna structure and eventually connect to its feed point. In the case of a bifilar helix antenna used as an infinite balun, the last quarter wavelength of cable before the feed point functions as a transformer that is a simple section of cable of $Z_0$ greater than 50 ohms. For optimal matching at a center frequency, the cable characteristic impedance is calculated according to the following equation: $Z_0 = \sqrt{Z_{0feedcable} * Z_{0antenna}}$, wherein $Z_{0\ feed\ cable} = 50$ ohms.

Antenna patterns in the category of bifilar antennas are of cardioid shape, with only small differences in the shape between the bifilar antenna pattern and its corresponding quadrifilar antenna pattern. As stated above, the bifilar helix antenna can be made by simply removing one of the bifilars of a quadrifilar helix antenna. Among the differences between the two designs are that the bifilar will have poorer circular polarization and pattern symmetry in the azimuth plane, since there are only two versus four elements defining a circle. Also it has more undesirable backside radiation, since the arraying of two bifilar helixes in the quadrifilar helix helps reduce backside radiation. Also the bifilar must be fed in back fire mode and must be long enough to be a traveling wave antenna before unidirectional patterns of cardioid shape occur off of the fed end of the antenna. If the bifilar is too short, then lobes will come off of both ends creating a figure eight pattern along the antenna axis. A quadrifilar helix does not have this length requirement since it is an array of two interleaved bifilars. The phasing of the array can force unidirectionality by eliminating one of the two lobes of the figure eight pattern.

If lengthening of the filar elements is necessary to maintain the cardioid shaped pattern when changing from the quadrifilar case to the bifilar case, then there will be some change in the patterns. For low pitch angles (e.g. twenty to thirty degrees) the patterns become sharper. For high pitch angles (e.g. forty to fifty degrees) patterns will split more, which may require reducing the pitch angle if acceptable overhead patterns are desired.

SUMMARY OF THE INVENTION

It is a general purpose and object of the present invention to convert a direct fed wide element quadrifilar helix antenna to a direct fed bifilar helix antenna with approximately the same antenna pattern.

It is a further purpose and object to reduce the number of feed cables for use with an antenna from two to one.

It is a further purpose and object that a single cable feeds the antenna via an infinite balun that is formed by the antenna itself.

It is a further purpose and object to eliminate the need for power splitters.

It is a further purpose and object for the direct fed wide element bifilar helix antenna to have the practical lowest $Z_0$ value around 50 ohms, to be able to match the 50 ohm feed cable.

The above objects are accomplished with the present invention by removing one of the bifilars of a prior art quadrifilar helix antenna, lengthening the remaining bifilar as needed to obtain the desired unidirectional pattern, employing the bifilar as an infinite balun to bring a feed cable onto the antenna structure and eventually connect the feed cable to the antenna feed point, and widening the elements of the remaining bifilar such that the widths of the elements are as wide as practically possible before they touch and overlap (approximately 98.5% of the available width) thereby obtaining the practical lowest $Z_0$ value of approximately 50 ohms so that there is no need of a matching network.

BRIEF DESCRIPTION OF THE DRAWINGS

A more complete understanding of the invention and many of the attendant advantages thereto will be more readily appreciated by referring to the following detailed description when considered in conjunction with the accompanying drawings, wherein like reference numerals refer to like parts and wherein.

DETAILED DESCRIPTION OF THE INVENTION

Figure 1B:
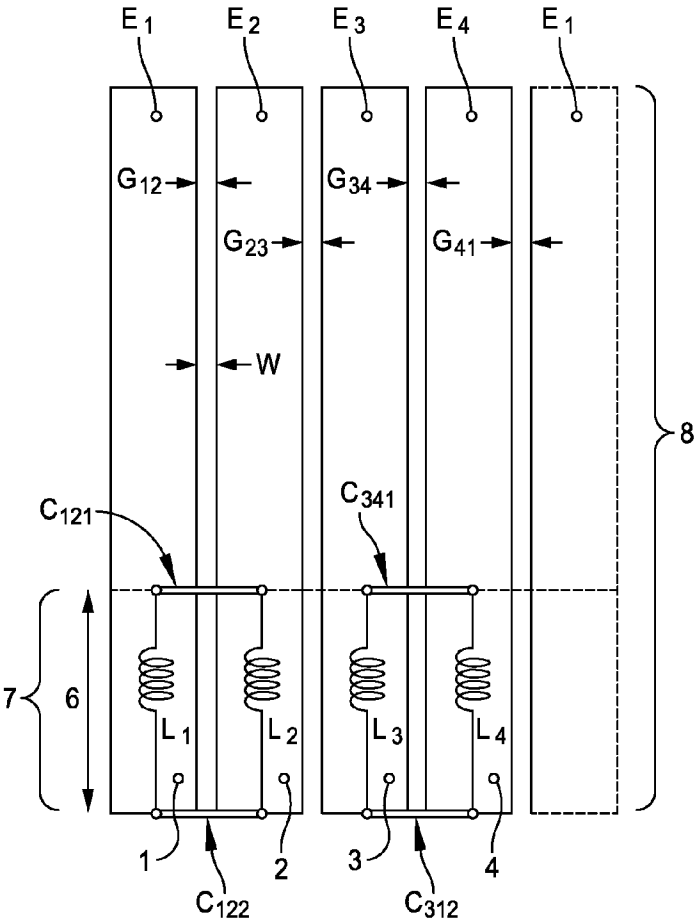
FIG. 1*b* illustrates the quadrifilar elements of the cross section of FIG. 1*a* unwrapped and unpitched to more easily show the inductance per unit length of the elements.
Figure 1A:
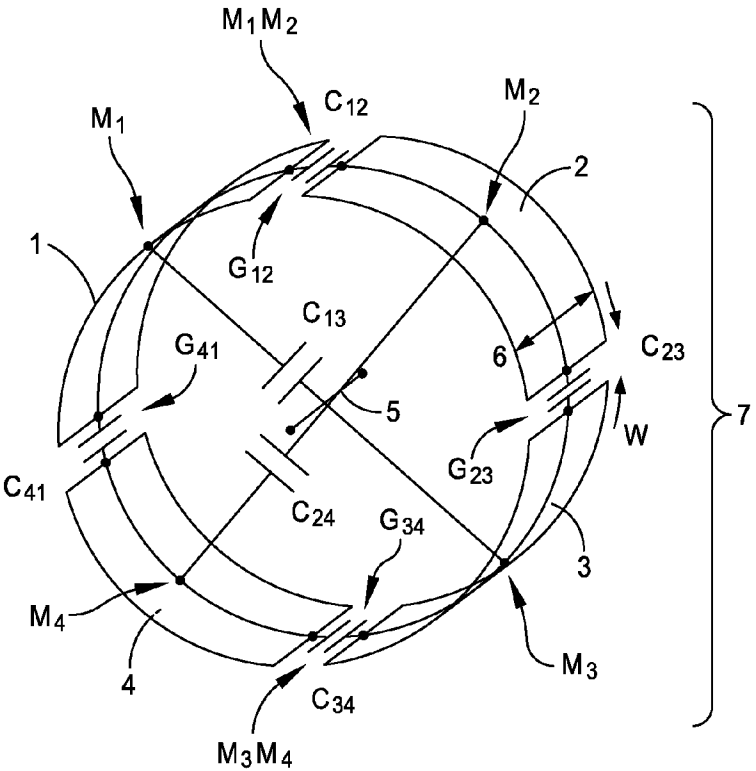
FIG. 1*a* illustrates a cylindrical cross section of a quadrifilar helix antenna unpitched to show the sources of capacitance per unit length of element.
Figure 2:
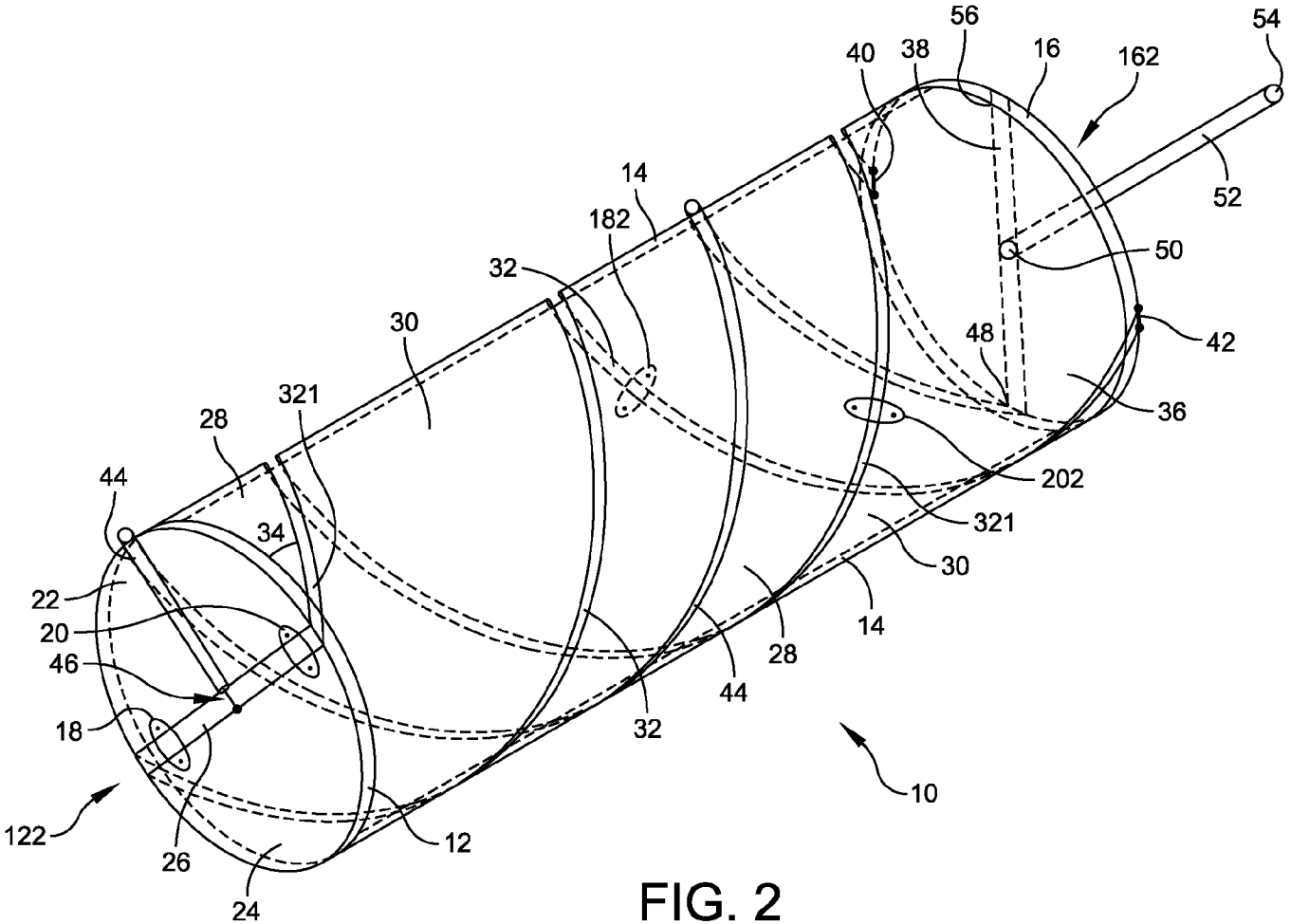
FIG. 2 illustrates the apparatus of the direct fed bifilar helix antenna of the present invention.

Referring to FIG. 2, there is illustrated the apparatus of the direct fed bifilar helix antenna 10. In the figure, the antenna 10 at one end 122 consists of an optional support disc 12 made of a dielectric material at one end of an optional support cylinder 14 made of a dielectric material and whose other end 162 has another optional support disc 16 made of dielectric material at the other end of the optional support cylinder 14. In an alternative embodiment where the metal parts of the antenna 10 are self supporting then the aforementioned optional support discs 14 and 16 and optional support cylinder 14 are not present. In an alternative embodiment, two insulating spacers 18 and 20 are bolted across the two bifilar elements of antenna 10 to hold the two bifilar elements in place relative to each other thereby providing minimum support.

At the feed end of the antenna where optional support disc 12 is located, the two radially opposite elements of the bifilar helix start as radial sections 22 and 24. These sections 22 and 24 cover most of optional support disc 12, except for a small gap 26 that separates them. The two radially opposite elements continue on optional support cylinder 14 as circumferential section 28 and circumferential section 30 approximately covering the entire cylinder circumference, and separated by gap 32 and gap 321. In the alternative embodiment where there is no support cylinder 14, insulating spacers, such as 182 and 202, are placed along the length of helix 10 half way between the ends 122 and 162 of the antenna and bolted across gaps 32 and 321 between the circumferential sections 28 and 30, to make the two sections a more solid structure, and to help prevent the circumferential sections 28 and 30 from unraveling or touching each other. For ease of viewing, the spacers have been drawn closer to end 162 in FIG. 2. Additional spacers may be added along the length of the gaps for further solidity. The circumferential sections 28 and 30 wrap about the cylinder length at pitch angle 34. Cardioid antenna pattern shapes become broader as pitch angle 34 increases. If the element lengths become too long electrically and pitch angle 34 is large (roughly greater than or equal to forty degrees) the antenna patterns will start to split.

The radial sections 22 and 24 and the circumferential sections 28 and 30 of the bifilar elements are made of low loss conductive metal such as copper or silver. At the end 162 of optional support cylinder 14 the location of optional support disc 16, the elements 28 and 30 are shorted by a metal disc 36 that is positioned on optional support disc 16. Optionally, disks 36 and 16 may be combined as one disk if it is strong enough to support the antenna. In an alternative embodiment the short is a wide wire 38 and a section of the feed cable 44 connecting the ends and midpoints of circumferential sections 28 and 30. In another alternative embodiment, the short is two wire shorts 40 and 42 that are placed across the gaps between the ends of the circumferential sections 28 and 30. The feed cable 44 may be inserted onto the antenna 10 at one of these shorts, however, these types of shorts 40 and 42 are not optimal because it is preferable to insert the feed cable 44 onto the antenna 10 at a radio frequency point of zero that is at a symmetrical point on the antenna 10 somewhere on the axis of the antenna. Wire shorts 40 and 42 are not exactly at radio frequency points of zero, since they lie off axis.

The width (or circumference) of the elements is approximately 98.5% of the available width (or circumference), so that the antenna characteristic impedance is 50 ohms. The width of gaps 26, 32 and 321 comprise the remaining available width, which is 1.5%. Some adjustment of the gap width may be necessary for to obtain 50 ohms, since the impedance model discussed above is approximate. Also there is a small impedance dependence on pitch angle, and on the thickness of the bifilar elements 22 and 28, and 24 and 30. The edges of thicker elements will increase capacitance across the gaps and reduce the characteristic impedance.

The antenna is fed at the midpoints of the elements, on the radial sections 22 and 24, on the axis of the antenna at feed point 46. The feed point 46 is connected to a 50 ohm coaxial feed cable 44, with the center conductor connecting to radial section 24 and the inside of the outer conductor connecting to radial section 22. The feed cable 44 is snaked around the entire length of the antenna 10, positioned at the centers of radial section 22 and circumferential section 28, where its outer conductor is attached to the sections. It continues to the end of circumferential section 28 to a point 48 on metal disc 36 and continues to the center 50 of metal disc 36, which is at a radio frequency zero (rf=0) point. The whole cable path from feed point 46 to the center 50 of metal disc 36 is an infinite balun, which allows the feed cable 44 to be introduced onto the antenna 10 and connect to the antenna's feed point 46. At the center 50 of metal disc 36, the feed cable 44 leaves the antenna for a section of length 52. A radio frequency signal is applied to the antenna 10 at a point 54 on the end of cable 44. The main beam of the pattern will come off of the feed point 46 end 122 of the antenna.

In an alternative embodiment, metal shorting disc 36 is removed and the antenna 10 is shorted just by the path established by the outside of the outer conductor of the section of feed cable 44 from point 48 to the center point 50 of the original metal disc 36 and by an added section of wide wire 38 of diameter similar to that of the cable from point 50 to the center of the edge of circumferential section 30 at 56. In another embodiment, wherein wire shorts 40 and 42 are employed, instead of following a path from point 48 to point 50, the feed cable 44 snakes from point 48 to wire short 40 and then leaves the antenna as a section of length of cable similar to section 52. It is noted, however, that this is not the best method of feed the antenna 10, since the feed cable 44 leaves antenna 10 at the radius of the antenna instead of at a symmetrical, on axis point.

In an alternative embodiment, the filar elements are made narrower so that a higher antenna $Z_0$ value results, so that the antenna can be matched to and fed with a higher $Z_0$ cable. For example, $Z_0$ can be raised to 75 ohms so that a 75 ohm cable can be used to feed the antenna.

The advantages of the antenna 10 of the present invention over prior art quadrifilar helix antennas is that the design is far less complex requiring no power splitters as opposed to three power splitters in the prior art antennas, only one versus two feed cables, and only two versus four antenna elements, while performing as a direct fed, 50 ohm broadband antenna with satellite coverage patterns. The advantage of the antenna 10 of the present invention over prior art bifilar helix antennas is there is no need for a matching transformer that may have limited bandwidth.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

What is claimed is:

1. A helix antenna comprising:

a cylindrical support tube of dielectric material having a first end and a second end;

a first support disc of dielectric material joined to the first end of the cylindrical support tube;

a second support disc of dielectric material joined to the second end of the cylindrical support tube;

a first elongated filar element and a second elongated filar element, wherein both elongated filar elements are wound around said cylindrical support tube in a radially opposite, helical arrangement covering the entire circumference and surface area of the cylindrical support tube with the exception of three gaps, a first gap at the first end of the cylindrical support tube, a second gap that runs along the sides of the cylindrical support tube and a third gap that run along the opposite sides of the cylindrical support tube, said first, second and third gap separating the two elongated filar elements, said first and second elongated elements being supported by said first support disc at the first end of the cylindrical support tube and by said second support disc at the second end of the cylindrical support tube;

an electrically conducting metal disc with a gap across its diameter that divides the disc into two halves, a first half and a second half, positioned on the first support disc, wherein the first half is joined to the first elongated filar element and the second half is joined to the second elongated filar element;

a coaxial feed cable having a center conductor joined to the center of the first half of the electrically conducting metal disc and also connected to the first elongated filar element via the first half of the electrically conducting metal disc, and an outer conductor joined to the center of the second half of the electrically conducting metal disc and also is connected to the second elongated filar element via the second half of the electrically conducting metal disc, wherein the coaxial feed cable is joined to the antenna at a feed point on the axis of said antenna; and a means for establishing an electrical short between the ends of the first elongated filar element and the second elongated filar element, wherein the coaxial feed cable is wrapped around the length of the antenna positioned at the center of the second elongated filar element continuing to a center of said means for establishing an electrical short placed across the ends of the first and second elongated filar elements which is a radio frequency zero point and then beyond the radio frequency zero point for a predetermined length, such that the entire coaxial feed cable path from the feed point to the center of the short is an infinite balun.

2. The helix antenna of claim 1 wherein the means for establishing an electrical short between the first elongated filar element and the second elongated filar element comprises an electrically conducting metal shorting disc positioned on the second support disc that functions at its center as a short between the first elongated filar element and the second elongated filar element.

3. The helix antenna of claim 1 wherein the means for establishing an electrical short between the first elongated filar element and the second elongated filar element comprises a wide wire disposed on the second support disc connecting the end and midpoint of the first elongated filar element to the outside of the outer conductor of one end of a section of the coaxial feed cable at the center of the second support disc, and the outside of the outer conductor at the other end of the section of the coaxial feed cable connecting to the end and midpoint of the second elongated filar element, to function at the center of the support disc as a short between the first and second elongated filar element.

4. The helix antenna of claim 3 wherein the coaxial feed cable snakes from a centered point on the end edge of the second elongated filar element to the axis of the antenna where it connects to the end of the wide wire and then leaves the antenna as a section of predetermined length of cable.

5. The helix antenna of claim 1 wherein the means for establishing an electrical short between the first elongated filar element and the second elongated filar element comprises:

a first wire short placed across the second gap between the ends of the first elongated filar element and the second elongated filar element;

a second wire short placed across the third gap between the ends of the first elongated filar element and the second elongated filar element; and wherein the coaxial feed cable is wrapped around the length of the antenna positioned at the center of the second elongated filar element continuing instead to a corner end of the second elongated filar element where it crosses the second elongated filar element to one of the two wire shorts.

6. The helix antenna of claim 5 wherein the coaxial feed cable snakes from a centered point on the end edge of the second elongated filar element to the first wire short and then leaves the antenna as a section of predetermined length of cable.

7. The helix antenna of claim 1 wherein the first elongated filar element and the second elongated filar element are made of a low loss conductive metal such as copper or silver.

8. The helix antenna of claim 1 wherein the width of the first elongated filar element and the width of the second elongated filar element are as wide as practically possible without allowing either elongated filar element to touch or overlap the other.

9. The helix antenna of claim 1 wherein the coaxial feed cable is a 50 ohm coaxial feed cable.

10. The helix antenna of claim 1 wherein the feed point of the antenna where the antenna is joined to the 50 ohm coaxial feed cable is located at the midpoints of the first elongated filar element and the second elongated filar element on the axis of the antenna.

11. A helix antenna comprising:

a first elongated filar element and a second elongated filar element, wherein both elongated filar elements are wound in a radially opposite, helical arrangement in the shape of a cylinder, said cylinder shape having a first end and a second end, with the exception of three gaps, a first gap at the first end of the cylinder shape, a second gap that runs along the sides of the cylinder shape and a third gap that runs along the opposite sides of the cylinder shape, said first, second and third gap separating the two elongated filar elements;

a first support disc of dielectric material supporting said first and second elongated filar elements at the first end of said cylinder shape;

a second support disc of dielectric material supporting said first and second elongated filar elements at the second end of said cylinder shape;

a plurality of spacers placed along the length of the antenna and across the first and second elongated filar elements at the first, second and third gaps that separates the two elongated filar elements to prevent the two elongated filar elements from unraveling or coming into contact;

an electrically conducting metal disc with a gap across its diameter that divides the disc into two halves, a first half and a second half, positioned on the first support disc, wherein the first half is joined to the first elongated filar element and the second half is joined to the second elongated filar element;

a coaxial feed cable having a center conductor joined to the center of the first half of the electrically conducting metal disc and also connected to the first elongated filar element via the first half of the electrically conducting metal disc, and an outer conductor joined to the center of the second half of the electrically conducting metal disc and also is connected to the second elongated filar element via the second half of the electrically conducting metal disc, wherein the coaxial feed cable is joined to the antenna at a feed point on the axis of said antenna; and a means for establishing an electrical short between the ends of the first elongated filar element and the second elongated filar element, wherein the coaxial feed cable is wrapped around the length of the antenna positioned at the center of the second elongated filar element continuing to a center of said means for establishing an electrical short placed across the ends of the first and second elongated filar elements which is a radio frequency zero point and then beyond the radio frequency zero point for a predetermined length, such that the entire coaxial feed cable path from the feed point to the center of the short is an infinite balun.

12. The helix antenna of claim 11 wherein the means for establishing an electrical short between the first elongated filar element and the second elongated filar element comprises an electrically conducting metal shorting disc positioned on the second support disc that functions at its center as a short between the first elongated filar element and the second elongated filar element.

13. The helix antenna of claim 11 wherein the means for establishing an electrical short between the first elongated filar element and the second elongated filar element comprises a wide wire disposed on the second support disc connecting the end and midpoint of the first elongated filar element to the outside of the outer conductor of one end of a section of the coaxial feed cable at the center of the second support disc, and the outside of the outer conductor at the other end of the section of the coaxial feed cable connecting to the end and midpoint of the second elongated filar element, to function at the center of the support disc as a short between the first and second elongated filar element.

14. The helix antenna of claim 13 wherein the coaxial feed cable snakes from a centered point on the end edge of the second elongated filar element to the axis of the antenna where it connects to the end of the wide wire and then leaves the antenna as a section of predetermined length of cable.

15. The helix antenna of claim 13 wherein the coaxial feed cable snakes from a centered point on the end edge of the second elongated filar element to the first wire short and then leaves the antenna as a section of predetermined length of cable.

16. The helix antenna of claim 11 wherein the means for establishing an electrical short between the first elongated filar element and the second elongated filar element comprises:

a first wire short placed across the second gap between the ends of the first elongated filar element and the second elongated filar element;

a second wire short placed across the third gap between the ends of the first elongated filar element and the second elongated filar element; and wherein the coaxial feed cable is wrapped around the length of the antenna positioned at the center of the second elongated filar element continuing instead to a corner end of the second elongated filar element where it crosses the second elongated filar element to one of the two wire shorts.

17. The helix antenna of claim 11 wherein the first elongated filar element and the second elongated filar element are made of a low loss conductive metal such as copper or silver.

18. The helix antenna of claim 11 wherein the width of the first elongated filar element and the width of the second elongated filar element are as wide as practically possible without allowing either elongated filar element to touch or overlap the other.

19. The helix antenna of claim 11 wherein the coaxial feed cable is a 50 ohm coaxial feed cable.

20. The helix antenna of claim 11 wherein the feed point of the antenna where the antenna is joined to the 50 ohm coaxial feed cable is located at the midpoints of the first elongated filar element and the second elongated filar element on the axis of the antenna.

* * * * *